US010858608B2

(12) United States Patent
Boehnke et al.

(10) Patent No.: US 10,858,608 B2
(45) Date of Patent: Dec. 8, 2020

(54) USE OF A HYDROCARBYL-SUBSTITUTED DICARBOXYLIC ACID FOR IMPROVING OR BOOSTING THE SEPARATION OF WATER FROM FUEL OILS AND GASOLINE FUELS

(71) Applicant: BASF SE, Ludwigshafen (DE)

(72) Inventors: Harald Boehnke, Mannheim (DE); Ludwig Voelkel, Limburgerhof (DE); Marc Walter, Frankenthal (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 16/154,952

(22) Filed: Oct. 9, 2018

(65) Prior Publication Data

US 2019/0040332 A1 Feb. 7, 2019

Related U.S. Application Data

(63) Continuation of application No. 14/903,095, filed as application No. PCT/EP2014/064012 on Jul. 2, 2014, now Pat. No. 10,174,269.

(30) Foreign Application Priority Data

Jul. 12, 2013 (EP) ..... 13176284

(51) Int. Cl.

| | |
|---|---|
| ***C10L 10/18*** | (2006.01) |
| ***C10G 33/04*** | (2006.01) |
| ***C10L 1/14*** | (2006.01) |
| ***C10L 1/198*** | (2006.01) |
| ***C10L 10/00*** | (2006.01) |
| ***C10L 1/195*** | (2006.01) |
| ***C10L 1/232*** | (2006.01) |
| ***C10L 1/28*** | (2006.01) |
| *C10L 1/16* | (2006.01) |
| *C10L 1/188* | (2006.01) |
| *C10L 1/189* | (2006.01) |
| *C10L 1/23* | (2006.01) |
| *C10L 1/233* | (2006.01) |
| *C10L 1/238* | (2006.01) |
| *C10L 1/2383* | (2006.01) |
| *C10L 1/2387* | (2006.01) |

(52) U.S. Cl.

CPC ..... *C10L 10/18* (2013.01); *C10G 33/04* (2013.01); *C10L 1/143* (2013.01); *C10L 1/146* (2013.01); *C10L 1/195* (2013.01); *C10L 1/198* (2013.01); *C10L 1/232* (2013.01); *C10L 1/285* (2013.01); *C10L 10/00* (2013.01); *C10L 1/1616* (2013.01); *C10L 1/1883* (2013.01); *C10L 1/1895* (2013.01); *C10L 1/1981* (2013.01); *C10L 1/1985* (2013.01); *C10L 1/231* (2013.01); *C10L 1/233* (2013.01); *C10L 1/238* (2013.01); *C10L 1/2383* (2013.01); *C10L 1/2387* (2013.01); *C10L 2200/0259* (2013.01); *C10L 2200/0272* (2013.01); *C10L 2200/0423* (2013.01); *C10L 2200/0438* (2013.01); *C10L 2200/0476* (2013.01); *C10L 2230/082* (2013.01); *C10L 2230/086* (2013.01); *C10L 2270/023* (2013.01); *C10L 2300/20* (2013.01)

(58) Field of Classification Search

CPC ..... C10L 10/18; C10L 1/143; C10L 1/146; C10L 1/198; C10L 10/00; C10L 1/195; C10L 1/232; C10L 1/285; C10L 1/1616; C10L 1/1883; C10L 1/1895; C10L 1/231; C10L 1/233; C10L 1/238; C10L 1/2383; C10L 1/2387; C10L 2230/086; C10L 2200/0438; C10L 2200/0423; C10L 2200/0476; C10L 2300/20; C10L 2200/0259; C10L 2200/0272; C10L 2230/082; C10L 2270/023; C10G 33/04

See application file for complete search history.

(56) References Cited

U.S. PATENT DOCUMENTS

| | | | |
|---|---|---|---|
| 3,304,162 | A | 2/1967 | Marvel, Jr. |
| 3,346,354 | A | 10/1967 | Kautsky |
| 3,346,355 | A | 10/1967 | Eckert |
| 3,447,918 | A | 6/1969 | Amick |
| 4,129,508 | A | 12/1978 | Friihauf |
| 4,152,499 | A | 5/1979 | Boerzel et al. |
| 4,398,921 | A | 8/1983 | Rifkin et al. |
| 4,605,808 | A | 8/1986 | Samson |
| 4,849,572 | A | 7/1989 | Chen et al. |

(Continued)

FOREIGN PATENT DOCUMENTS

| | | | |
|---|---|---|---|
| CA | 2027269 | A1 | 4/1991 |
| CN | 102277212 | A | 12/2011 |

(Continued)

OTHER PUBLICATIONS

International Search Report dated Oct. 10, 2014 in PCT/EP2014/064012.

International Preliminary Report on Patentability and Written Opinion dated Jan. 12, 2016 in PCT/EP2014/064012.

Office Action dated Apr. 19, 2017 in European Patent Application No. 14 734815.5.

Groysman, "Corrosion in systems for Storage and Transportation of Petroleum Products", 2014, Springer Science +Business Media Dordrecht.

*Primary Examiner* — Cephia D Toomer

(74) *Attorney, Agent, or Firm* — Oblon, McClelland, Maier & Neustadt, L.L.P.

(57) ABSTRACT

Use of a hydrocarbyl-substituted dicarboxylic acid for improving or boosting the separation of water from fuel oils and gasoline fuels which comprise additives with detergent action. A Fuel additive concentrate comprising the said hydrocarbyl-substituted dicarboxylic acid, certain additives with detergent action and optionally other customary additives and solvents or diluents.

12 Claims, No Drawings

(56) References Cited

U.S. PATENT DOCUMENTS

| | | | | |
|---|---|---|---|---|
| 4,877,416 | A | 10/1989 | Campbell | |
| 5,525,127 | A | 6/1996 | Jeffrey | |
| 5,551,957 | A | 9/1996 | Cunningham et al. | |
| 2004/0000089 | A1 | 1/2004 | Carabell et al. | |
| 2012/0144731 | A1* | 6/2012 | Bohnke | C10L 1/143 44/307 |
| 2013/0276362 | A1 | 4/2013 | Boehnke | |
| 2013/0192124 | A1* | 8/2013 | Arters | C10L 1/198 44/307 |
| 2015/0275116 | A1 | 4/2015 | Peretolchin et al. | |

FOREIGN PATENT DOCUMENTS

| | | | |
|---|---|---|---|
| DE | 1 645 705 | A1 | 7/1970 |
| EP | 0 244 616 | A2 | 11/1987 |
| EP | 0 280 417 | A1 | 8/1988 |
| EP | 0 310 875 | A1 | 4/1989 |
| EP | 0 356 725 | A1 | 3/1990 |
| EP | 0 700 985 | A1 | 3/1996 |
| EP | 1 375 629 | A2 | 1/2004 |
| GB | 2 285 057 | A | 6/1995 |
| GB | 2496514 | A | 5/2013 |
| WO | WO 2006/135881 | A2 | 12/2006 |
| WO | WO 2008/060888 | A2 | 5/2008 |
| WO | WO 2008/092809 | A1 | 8/2008 |
| WO | WO 2010/042378 | | 4/2010 |
| WO | WO 2010/132259 | A1 | 11/2010 |
| WO | WO 2011/095819 | A1 | 8/2011 |
| WO | WO 2011/146289 | A1 | 11/2011 |
| WO | WO 2012/004300 | A1 | 1/2012 |
| WO | WO 2012/076428 | A1 | 6/2012 |
| WO | WO 2013/064689 | A1 | 5/2013 |
| WO | WO 2013/087701 | A1 | 6/2013 |
| WO | WO 2013/117616 | A1 | 8/2013 |
| WO | WO 2014/064151 | A1 | 5/2014 |
| WO | WO 2014/146928 | A1 | 9/2014 |
| WO | WO 2014/195464 | A1 | 12/2014 |
| WO | WO 2014/202425 | A2 | 12/2014 |
| WO | WO 2015/040147 | A1 | 3/2015 |

* cited by examiner

USE OF A HYDROCARBYL-SUBSTITUTED DICARBOXYLIC ACID FOR IMPROVING OR BOOSTING THE SEPARATION OF WATER FROM FUEL OILS AND GASOLINE FUELS

The present invention relates to the use of a hydrocarbyl-substituted dicarboxylic acid comprising at least one hydrocarbyl substituent of from 10 to 3000 carbon atoms for improving or boosting the separation of water from fuel oils and gasoline fuels which comprise (B) at least one additive with detergent action.

Fuel oils such as middle distillates, e.g. diesel fuels, heating oils or jet fuels, as well as gasoline fuels often contain small amounts of water, typically in the region of from several parts per millions up to several percent by weight, due to condensation of water into the cold fuel oils or gasoline fuels and into the storage tanks and pipelines during transport and storage. This amount of water partly separates as a layer at the bottom of the storage tank and partly is emulsified in the fuel oil or gasoline fuel. The presence of water is undesired as it can cause severe problems on transport and on use in combustion engines and heating devices.

German laid open Patent Application 1 645 705 (1) discloses to use of amides of carboxylic acids to dehaze hydrocarbon mixtures, e.g. heating oil and diesel fuel. No hint is given to any possible interactions or synergistic interactions of the said amides with further middle distillate performance additives such as additives with detergent action or further additives with dehazing action. As the teaching of (1) refers to dehaze the hydrocarbon mixtures, i.e. to clear them up by generating hydrocarbon-water-emulsions, such technical solution may only work with relatively small amounts of water; this method will fail with larger amounts of water.

Chinese Patent Application 102277212 A (2) relates to a diesel performance additive which is a mixture of tall oil fatty acids, an oleic acid amide and a naphthenic acid imidazoline. The said three-component additive is recommended as an emulsifying agent to dehaze and clear up diesel fuels. Similar to (1) above, no hint is given to any possible interactions or synergistic interactions of the said amides with further middle distillate performance additives such as additives with detergent action or further additives with dehazing action. As the teaching of (2) also refers to dehaze the diesel fuels, i.e. to clear them up by generating hydrocarbon-water-emulsions, such technical solution may only work with relatively small amounts of water; this method will fail with larger amounts of water.

U.S. Pat. No. 4,129,508 (3) discloses reaction products of hydrocarbyl-substituted succinic acids or their anhydrides with polyalkylene glycols or their monoethers, organic alkaline metal salts and alkoxylated amines. Such reaction products act as demulsifiers in fuels like diesel fuel.

Canadian Patent Application 2 027 269 (4) discloses reaction products of alkenyl or alkyl succinic acids or their anhydrides, exhibiting at most 32 carbon atoms in the alkyenyl or alkyl substituent, respectively, with alkylether diamines. Such reaction products act as dehazers in hydrocarbon fuels.

"Dehazing" as referred to in several of the cited documents above and as generally understood in the art shall mean clearing up water-containing hydrocarbons or diesel fuels, respectively, by generating clear hydrocarbon-water-emulsions ("emulsification") and shall not include separating water in separate phase ("demulsification"), thus enabling to remove the water by phase separation.

There is a need to separate also larger amounts of water from fuel oils and gasoline fuels using suitable additive which are capable of completely or practically completely remove the water from the fuel oils and gasoline fuels. Such additives should interact with other performance additives present in the fuel oils or gasoline fuels in an advantageous way. Especially, the tendency of modern additives with detergent action to support the undesired formation and stabilization of fuel oil-water-emulsions or gasoline fuel-water-emulsions should be counteracted.

Accordingly, the above defined use of a hydrocarbyl-substituted dicarboxylic acid (A) for improving or boosting the separation of water from fuel oils and gasoline fuels comprising one or more additives with detergent action has been found.

According to the present invention, water present in the fuel oils or gasoline fuels is separated as a layer at the bottom of a separation device and, thereafter, can be easily removed. The water content in fuel oils or gasoline fuels which can be removed in this way is normally from about 200 ppm by weight to about 10% by weight, especially from about 1000 ppm by weight to about 5% by weight. Emulsifying water in the fuel oil or gasoline fuel by interaction with the hydrocarbyl-substituted dicarboxylic acid (A) occurs only to a negligible minor amount.

According to the present invention, the hydrocarbyl-substituted dicarboxylic acid (A) improves and completes the phase separation of water from the fuel oils and gasoline fuels which occurs with larger amounts of water present in the fuel oils or gasoline fuels already without any performance additive but in an incomplete way. Furthermore, (A) boosts the phase separation of water from fuel oils and gasoline fuels if other surface active additives, especially certain commercially available dehazers, are already present in the fuel oils and gasoline fuels. Astonishingly, the interaction between (A) and certain commercially available dehazers which are by nature emulsifying additives also leads to an improved demulsifying and water phase separating action.

The hydrocarbyl-substituted dicarboxylic acid (A) is applied in the form of the free acid, i.e. two COOH groups are present, or in the form of the anhydride which may be an intramolecular anhydride (like succinic anhydride, glutaric anhydride or phthalic anhydride) or an intermolecular anhydride linking two dicarboxylic acid molecules together. To a minor extent, some of the carboxylic functions may be present in salt form, e.g. as alkali or alkaline metal salts or as ammonium or substituted ammonium salts, depending on the pH value of the liquid phase. A single hydrocarbyl-substituted dicarboxylic acid species (A) or a mixture of different hydrocarbyl-substituted dicarboxylic acids (A) may be used.

The hydrocarbyl substituent to the instant dicarboxylic acids preferably exhibits from 12 to 2000, more preferably from 14 to 1000, still more preferably from 16 to 500, most preferably from 20 to 200 carbon atoms. The hydrocarbyl substituent may be saturated or unsaturated, linear or branched; it may also include alicyclic, heterocyclic or aromatic ring systems. Typical examples of hydrocarbyl substituents include linear and branched alkyl and alkenyl radical with 10, 11, 12, 13, 14, 15, 16, 17, 18, 19, 20, 21, 22, 24, 26, 28 and 30 carbon atoms in the chain.

In many cases such hydrocarbyl substituents are synthetically produced by oligomerization or polymerization of olefin monomers such as ethene, propene, 1-butene, 2-butene, isobutene, 1-penten, 1-hexen, 1-octen or 1-decen; follow-up transformations of such oligomerization or polymerization products may be applied. As typical examples, dodecyl or dodecenyl substituents are produced by tetramerization of propene or trimerization of butenes and tridecyl or tridecenyl substituents are made from the aforementioned $C_{12}$-substituents by subsequent hydroformylation.

In case of substituents with 10 to about 30 carbon atoms, such substituents may also be of natural origin. Substituents of natural origin are normally derived from saturated or unsaturated fatty acids or the corresponding fatty alcohols. Such substituents of natural origin are in most cases linear.

In a preferred embodiment, the at least one hydrocarbyl substituent of (A) is a polyisobutenyl substituent comprising from 20 to 200, preferably from 24 to 160, more preferably from 28 to 140, most preferably from 32 to 100 carbon atoms. As an alternative when considering a possible distribution of homologous polymer species, the length of the polyisobutenyl substituent can be defined by its number average molecular weight ($M_n$) of from 300 to 2800, preferably of from 350 to 2300, more preferably of from 400 to 2000, most preferably of from 450 to 1400; such $M_n$ numbers normally relate to a polydispersity ($M_w/M_n$) of from 1.1 to 4, preferably of from 1.3 to 2.5. A typical polyisobutenyl substitutent comprises from 60 to 80 carbon atoms or is defined by a number average molecular weight of from 850 to 1150.

Depending on the way of synthesizing the polyisobutenyl-substituted dicarboxylic acid and attaching the polyisobutenyl substituent to the dicarboxylic acid molecule, i.e. to the bridging group between the two carboxylic functions, the polyisobutenyl substituent may be saturated, e.g. when attaching a polyisobutyl halide to an aromatic dicarboxylic acid (such as phthalic acid) via Friedel-Crafts reaction or to an olefinically unsaturated dicarbocylic acid (such as maleic acid or maleic anhydride), or may contain an olefinic double bond next to the link-up to the dicarboxylic acid molecule, e.g. when attaching a polyisobuten molecule with a terminal double bond to an olefinically unsaturated dicarbocylic acid (such as maleic acid or maleic anhydride) via en reaction.

The hydrocarbyl-substituted dicarboxylic acid (A) itself may be of aliphatic, cycloaliphatic, araliphatic or aromatic nature, aliphatic dicarboxylic acids being preferred. Typical hydrocarbyl-substituted dicarboxylic acids (A) suitable for the present invention are derived from hydrocarbyl-substituted malonic acid, hydrocarbyl-substituted succinic acid, hydrocarbyl-substituted glutaric acid, hydrocarbyl-substituted adipic acid, hydro-carbyl-substituted pimelic acid, hydrocarbyl-substituted suberic acid, hydrocarbyl-substituted azelaic acid, hydrocarbyl-substituted sebacic acid, hydrocarbyl-substituted undecanedioic acid, hydrocarbyl-substituted dodecanedioic acid, hydrocarbyl-substituted phthalic acid, hydrocarbyl-substituted isophthalic acid, hydrocarbyl-substituted terephthalic acid, hydrocarbyl-substituted o-, m- or p-phenylene diacetic acid, hydro-carbyl-substituted maleic acid, hydrocarbyl-substituted fumaric acid and hydrocarbyl-substituted glutaconic acid.

In a preferred embodiment, the hydrocarbyl-substituted dicarboxylic acid (A) comprises a hydrocarbylene bridging group between the two carboxylic functions of from 1 to 10, preferably of from 2 to 8, more preferably of from 2 to 6, most preferably of 2, 3 or 4 carbon atoms in a line. Such bridging carbon atom line may be a linear aliphatic alkylene or alkenylene chain with or without C1- to $C_4$-side chains, an araliphatic bridging group incorporating a benzene ring into the aliphatic carbon atom chain, or a phenylene bridging group.

In an especially preferred embodiment, the hydrocarbyl-substituted dicarboxylic acid (A) is a polyisobutenylsuccinic acid with one polyisobutenyl substituent comprising from 20 to 200, preferably from 24 to 160, more preferably from 28 to 140, most preferably from 32 to 100 carbon atoms or, as an alternative, with a polyisobutenyl with a number average molecular weight (Me) of from 300 to 2800, preferably of from 350 to 2300, more preferably of from 400 to 2000, most preferably of from 450 to 1400. Such preferred polyisobutenylsuccinic acid may also be applied according to the present invention in the form of the polyisobutenylsuccinic anhydride.

Polyisobutenylsuccinic acids with two free COOH functions which are suitable for use of water separation from fuel oils according the present invention can be easily prepared in dry substance by hydrolysis of the corresponding anhydrides, i.e. by simply mixing the said anhydrides with the equimolar amount of water and heating up to a temperature of from about 70° C. to about 120° C. for a sufficient time period (usually from 2 to 20 hours).

In a preferred embodiment one or both, preferably one carboxylic acid group of compound (A) can be the salt of substituted ammonium salts. Preferred are quaternary ammonium salts in which the sum of carbon atoms in all four substituents is at least 10, preferably at least 12, more preferably at least 14, and most preferably at least 16.

The substituents are selected from the group consisting of $C_1$- to $C_{20}$-alkyl, 2-hydroxy-$C_2$- to $C_{20}$-alkyl, $C_6$- to $C_{14}$-aryl, $C_5$- to $C_{14}$-heteroaryl, $C_7$- to $C_{14}$-aralkyl, and ω-hydroxy-polyoxy-$C_2$- to $C_{50}$-alkylene. Preferably the substituents are selected from the group consisting of $C_1$- to $C_{20}$-alkyl, 2-hydroxy-$C_2$- to $C_{20}$-alkyl, and ω-hydroxy-polyoxy-$C_2$- to $C_{50}$-alkylene.

Examples for such substituents are methyl, ethyl, isopropyl, n-propyl, n-butyl, iso-butyl, sek-butyl, tert-butyl, n-hexyl, n-heptyl, n-octyl, n-decyl, n-dodecyl, n-tetradecyl, n-hexadecyl, n-octadecyl, n-eicosyl, 2-ethylhexyl, 2-propylheptyl, 2-hydroxyethyl, 2-hydroxypropyl, 2-hydroxybutyl, poly ethylene oxide bearing 2 to 20 units of ethylene oxide, and poly propylene oxide bearing 2 to 20 units of propylene oxide.

Preferred substituted ammonium salts are those which are obtainable by reaction of a tertiary amine with an epoxide, such as ethylene oxide, propylene oxide, butylene oxide or styrene oxide.

Such tertiary amines are preferably dimethyl fatty amines bearing 6 to 22 carbon atoms or polyalkylene oxides bearing 2 to 20 units of ethylene oxide and/or propylene oxide started on dimethyl amine, diethyl amine, morpholine, piperidine or pyrrolidine.

Additives with detergent action of component (B) refer, in the context of the present invention, to those compounds whose effect in an internal combustion engine or in a heating device, especially in a compression-ignition engine or in a spark ignition engine, such as a diesel engine or a gasoline engine, consists predominantly or at least essentially of eliminating and/or preventing deposits, especially in the injectors or in the intake system of the engines. Therefore, such "detergents" or "additives with detergent action" are also called "deposit control additives". The detergents are preferably amphiphilic substances which have at least one hydrophobic hydro-carbyl radical having a number-average molecular weight (Me) of 85 to 20.000, especially of 300 to 5000, and in particular of 500 to 2500, and at least one polar moiety.

In a preferred embodiment of the present invention, the fuel oils comprise at least one additive component with detergent action (B) which is selected from (i) compounds with moieties derived from succinic anhydride and having hydroxyl and/or amino and/or amido and/or imido groups;

(ii) nitrogen compounds quaternized in the presence of an acid or in an acid-free manner, obtainable by addition of a compound comprising at least one oxygen- or nitrogen-containing group reactive with an anhydride and additionally at least one quaternizable amino group onto a polycarboxylic anhydride compound and subsequent quaternization;

(iii) polytetrahydrobenzoxazines and bistetrahydrobenzoxazines, (iv) polyisobutenyl monoamines and polyisobutenyl polyamines;

(v) polyoxy-$C_2$- to $C_4$-alkylene compounds terminated by mono- or polyamino groups, at least one nitrogen atom having basic properties.

Additive components (B) may comprise one single species of groups (i), (ii), (iii), (iv) or (v) or a mixture of different species from one of groups (i) to (v) or a mixture of different species from several groups (i) to (v).

Additives (i) comprising moieties deriving from succinic anhydride and having hydroxyl and/or amino and/or amido and/or imido groups are preferably corresponding derivatives of polyisobutenylsuccinic anhydride, which are obtainable by reaction of conventional or high-reactivity polyisobutene with $M_n$=300 to 5000, in particular with $M_n$=500 to 2500, with maleic anhydride by a thermal route or via the chlorinated polyisobutene. Of particular interest in this context are derivatives with aliphatic polyamines such as ethylenediamine, diethylenetriamine, triethylenetetramine or tetraethylenepentamine. The moieties with hydroxyl and/or amino and/or amido and/or imido groups are for example carboxylic acid groups, acid amides, acid amides of di- or polyamines, which, as well as the amide function, also have free amine groups, succinic acid derivatives with an acid and an amide function, carboxyimides with monoamines, carboxyimides with di- or polyamines, which, as well as the imide function, also have free amine groups, and diimides, which are formed by the reaction of di- or polyamines with two succinic acid derivatives. Such fuel additives are described especially in U.S. Pat. No. 4,849,572.

Nitrogen compounds quaternized in the presence of an acid or in an acid-free manner according to the above group (ii) are obtainable by addition of a compound which comprises at least one oxygen- or nitrogen-containing group reactive with an anhydride and additionally at least one quaternizable amino group onto a polycarboxylic anhydride compound and subsequent quaternization, especially with an epoxide, e.g. styrene or propylene oxide, in the absence of free acid, as described in WO 2012/004300, or with a carboxylic ester, e.g. dimethyl oxalate or methyl salicylate. Suitable compounds having at least one oxygen- or nitrogen-containing group reactive with anhydride and additionally at least one quaternizable amino group are especially polyamines having at least one primary or secondary amino group and at least one tertiary amino group. Useful polycarboxylic anhydrides are especially dicarboxylic acids such as succinic acid, having a relatively long-chain hydrocarbyl substituent, preferably having a number-average molecular weight $M_n$ for the hydrocarbyl substituent of 200 to 10.000, in particular of 350 to 5000. Such a quaternized nitrogen compound is, for example, the reaction product, obtained at 40° C., of polyisobutenylsuccinic anhydride, in which the polyisobutenyl radical typically has an $M_n$ of 1000, with 3-(dimethylamino)propylamine, which constitutes a polyisobutenylsuccinic monoamide and which is subsequently quaternized with dimethyl oxalate or methyl salicylate or with styrene oxide or propylene oxide in the absence of free acid.

Further nitrogen compounds according to the above group (ii) are described in

WO 2006/135881 A1, page 5, line 13 to page 12, line 14;

WO 10/132259 A1, page 3, line 28 to page 10, line 25;

WO 2008/060888 A2, page 6, line 15 to page 14, line 29;

WO 2011/095819 A1, page 4, line 5 to page 9, line 29;

GB 2496514 A, paragraph [00012] to paragraph [00041];

WO 2013/117616 A1, page 3, line 34 to page 11, line 2;

the unpublished European Patent application with the file number 13172841.2, application date Jun. 19, 2013, page 3, line 14 to page 5, line 9;

the unpublished European Patent application with the file number 13171057.6, application date Jun. 7, 2013, page 5, lines 28 to 35 and page 13, line 8 to page 17, line 28;

the unpublished European Patent application with the file number 13185288.1, application date Sep. 20, 2013, page 4, line 35 to page 5, line 10 and page 13, line 27 to page 21, line 2;

the unpublished International Patent application with the file number PCT/EP2013/072169, application date Oct. 23, 2013, page 5, line 18 to page 6, line 18 and page 15, line 26 to page 19, line 17;

WO 2013/064689 A1, page 18, line 16 to page 29, line 8; and

WO 2013/087701 A1, page 13, line 25 to page 19, line 30, each of which is incorporated herein by reference.

Polytetrahydrobenzoxazines and bistetrahydrobenzoxazines according to the above group (iii) are described in WO 2012/076428. Such polytetrahydro-benzoxazines and bistetrahydrobenzoxazines are obtainable by successively reacting, in a first reaction step, a $C_1$ to $C_{20}$-alkylenediamine having two primary amino functions, e.g. 1,2-ethylenediamine, with a $C_1$ to $C_{12}$-aldehyde, e.g. formaldehyde, and a $C_1$ to $C_8$-alkanol at a temperature of 20 to 80° C. with elimination and removal of water, where both the aldehyde and the alcohol can each be used in more than twice the molar amount, especially in each case in 4 times the molar amount, relative to the diamine, in a second reaction step reacting the condensation product thus obtained with a phenol which bears at least one long-chain substituent having 6 to 3000 carbon atoms, e.g. a tert-octyl, n-nonyl, n-dodecyl or polyisobutyl radical having an $M_n$ of 1000, in a stoichiometric ratio relative to the originally used alkylenediamine of 1.2:1 to 3:1 at a temperature of 30 to 120° C. and optionally in a third reaction step heating the bistetrahydrobenzoxazine thus obtained to a temperature of 125 to 280° C. for at least 10 minutes.

Polyisobutenyl monoamines and polyisobutenyl polyamines according to the above group (iv) are preferably based on polyisobutenes which comprise at least about 20%, preferably at least 50% and more preferably at least 70% of the more reactive methyl-vinylidene isomer. Suitable polyisobutenes include those prepared using $BF_3$ catalysts. The preparation of such polyisobutenes in which the methylvinylidene isomer comprises such a high percentage of the total composition is for example described in U.S. Pat. Nos. 4,152,499 and 4,605,808.

Examples of suitable polyisobutenes having such a high methylvinylidene content include UI-Travis® 30, a polyisobutene having a number average molecular weight ($M_n$) of about 1300 g/mol and a methylvinylidene content of about 74%, and Ultravis® 10, a 950 g/mol molecular weight polyisobutene having a methylvinylidene content of about 76%, both available from British Petroleum. Another example of a suitable polyiso-butene having a number average molecular weight ($M_n$) of about 1000 and a high methylvinyliden content is Glissopal® 1000, available from BASF SE.

The amine component of the polyisobutenyl monoamines or polyamines may be derived from ammonia, a monoamine or a polyamine. The monoamine or polyamine component comprises amines having from 1 to about 12 amine nitrogen atoms and from 1 to 40 carbon atoms. The carbon to nitrogen ratio may be between about 1:1 and about 10:1. Generally, the monoamine will contain from 1 to about 40 carbon atoms and the polyamine will contain from 2 to about 12 amine nitrogen atoms and from 2 to about 40 carbon atoms. The amine component may be a pure single product or a mixture of compounds having a major quantity of the designated amine.

When the amine component is a polyamine, it will preferably be a polyalkylene polyamine. Preferably, the alkylene group will contain from 2 to 6 carbon atoms, more preferably from 2, 3 or 4 carbon atoms. Examples of such polyamines include ethylene diamine, diethylene triamine, triethylene tetramine and tetraethylene pentamine. A preferred polyisobutenyl monoamine is the product obtained by hydroformylation and subsequent reductive amination with ammonia of a polyisobutene having a high methylvinylidene content, especially of at least 50% and more preferably at least 70%. The preparation of the said polyisobutenyl polyamines or monoamines is e.g. described in detail in EP-A 0 244 616.

The number average molecular weight ($M_a$) of the polyisobutenyl monoamines or polyamines used in the instant invention is usually in the range of from 500 to 2,500 g/mol, typically about 550, about 750, about 1000 or about 1,300 g/mol. A preferred range for the number average molecular weight of the polyisobutenyl monoamines or polyiso-butenyl polyamines is from 550 to 1000 g/mol. The polyisobutenyl monoamines or polyamines are mostly not pure single products, but rather mixtures of compounds having number average molecular weights as indicated above. Usually, the range of molecular weights will be relatively narrow having a maximum near the indicated molecular weight.

Polyoxy-$C_2$-$C_4$-alkylene compounds terminated by mono- or polyamino groups and having at least one nitrogen atom having basic properties, according to the above group (v), are preferably polyetheramines which are obtainable by reaction of $C_2$- to $C_{60}$-alkanols, $C_6$- to $C_{30}$-alkanediols, mono- or di-$C_2$- to $C_{30}$-alkylamines, to $C_{30}$-alkylcyclohexanols or $C_1$- to $C_{30}$-alkylphenols with 1 to 30 moles of ethylene oxide and/or propylene oxide and/or butylene oxide per hydroxyl group or amino group and, in the case of the polyethers as intermediates, by subsequent reductive amination with ammonia, monoamines or polyamines. Such products are described in particular in EP-A 310 875, EP-A 356 725, EP-A 700 985 and U.S. Pat. No. 4,877,416. Typical examples of additives of group (v) are tridecanol butoxylates, isotridecanol butoxylates, isononyl-phenol butoxylates and polyisobutenol butoxylates and propoxylates which are subsequently reacted with ammonia.

Within the scope of the present invention, the hydrocarbyl-substituted dicarboxylic acid (A) is preferably used together with quarternized nitrogen compounds (ii) for component (B) in case of fuel oils.

Within the scope of the present invention, the hydrocarbyl-substituted dicarboxylic acid (A) is preferably used together with compounds with moieties derived from succinic anhydride and having hydroxyl and/or amino and/or amido and/or imido groups (i) alone or together with polyisobutenyl monoamines or polyisobutenyl polyamines (iv) alone or together with a mixture of compounds with moieties derived from succinic anhydride and having hydroxyl and/or amino and/or amido and/or imido groups (i) and polyisobutenyl monoamines or polyisobutenyl polyamines (iv) for component (B) in case of gasoline fuels.

Furthermore, the present hydrocarbyl-substituted dicarboxylic acid (A) and the at least one additive with detergent action for component (B) exhibit superior performance—even in the sense of synergism—in improving and/or boosting the separation of water from fuel oils and gasoline fuels when applied together with at least one dehazer exhibiting emulsifying action on its own when used alone as additive component (C) selected from (C1) alkoxylation copolymers of ethylene oxide, propylene oxide, butylene oxide, styrene oxide and/or other oxides, e.g. epoxy based resins;

(C2) alkoxylated phenol formaldehyde resins.

Dehazer components (C1) and (C2) are normally commercially available products, e.g. the dehazer products available from Baker Petrolite under the brand name of Tolad® such as Tolad® 2898, 9360K, 9348, 9352K, 9327 or 286K.

In a further preferred embodiment of the present invention, the fuel oils additionally comprise as additive component (D) at least on cetane number improver. Cetane number improvers used are typically organic nitrates. Such organic nitrates are especially nitrate esters of unsubstituted or substituted aliphatic or cycloaliphatic alcohols, usually having up to about 10, in particular having 2 to 10 carbon atoms. The alkyl group in these nitrate esters may be linear or branched, and saturated or unsaturated. Typical examples of such nitrate esters are methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate and isopropylcyclohexyl nitrate and also branched decyl nitrates of the formula $R^1R^2CH—CH_2—O—NO_2$ in which $R^1$ is an n-propyl or isopropyl radical and $R^2$ is a linear or branched alkyl radical having 5 carbon atoms, as described in WO 2008/092809. Additionally suitable are, for example, nitrate esters of alkoxy-substituted aliphatic alcohols such as 2-ethoxyethyl nitrate, 2-(2-ethoxy-ethoxy)ethyl nitrate, 1-methoxypropyl nitrate or 4-ethoxybutyl nitrate. Additionally suitable are also diol nitrates such as 1,6-hexamethylene dinitrate. Among the cetane number improver classes mentioned, preference is given to primary amyl nitrates, primary hexyl nitrates, octyl nitrates and mixtures thereof. Most preferably, 2-ethylhexyl nitrate is present in the fuel oils as the sole cetane number improver or in a mixture with other cetane number improvers.

In the context of the present invention, fuel oils means preferably middle distillate fuels, especially diesel fuels. However, heating oils, jet fuels and kerosene shall also be encompassed. Diesel fuels or middle distillate fuels are typically mineral oil raffinates which generally have a boiling range from 100 to 400° C. These are usually distillates having a 95% point up to 360° C. or even higher. However, these may also be what is called "ultra low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, the main constituents of which are relatively long-chain paraffins, those obtainable in a synthetic way by coal gasification or gas liquefaction ["gas to liquid" (GTL) fuels] are suitable, too. Also suitable are mixtures of the aforementioned diesel fuels with renewable fuels (biofuel oils) such as biodiesel or bioethanol. Of particular interest at present are diesel fuels with low sulfur content, i.e. with a sulfur content of less than 0.05% by weight, preferably of less than 0.02% by weight, particularly of less than 0.005% by weight and especially of less than 0.001% by weight of sulfur.

In a preferred embodiment, the hydrocarbyl-substituted dicarboxylic acid (A) is used together with the aforementioned components (B), if desired (C) and, if desired (D), in fuel oils which consist (a) to an extent of 0.1 to 100% by weight, preferably to an extent of 0.1 to less than 100% by weight, especially to an extent of 10 to 95% by weight and in particular to an extent of 30 to 90% by weight, of at least one biofuel oil based on fatty acid esters, and (b) to an extent of 0 to 99.9% by weight, preferably to an extent of more than 0 to 99.9% by weight, especially to an extent of 5 to 90% by weight, and in particular to an extent of 10 to 70% by weight, of middle distillates of fossil origin and/or of synthetic origin and/or of vegetable and/or animal origin, which are essentially hydrocarbon mixtures and are free of fatty acid esters.

The hydrocarbyl-substituted dicarboxylic acid (A) can also be used together with the aforementioned components (B), if desired (C) and, if desired (D), in fuel oils which consist exclusively of middle distillates of fossil origin and/or of synthetic origin and/or of vegetable and/or animal origin, which are essentially hydrocarbon mixtures and are free of fatty acid esters.

Fuel oil component (a) is usually also referred to as "biodiesel". This preferably com-prises essentially alkyl esters of fatty acids which derive from vegetable and/or animal oils and/or fats. Alkyl esters typically refer to lower alkyl esters, especially $C_1$ to $C_4$-alkyl esters, which are obtainable by transesterifying the glycerides which occur in vegetable and/or animal oils and/or fats, especially triglycerides, by means of lower alcohols, for example, ethanol, n-propanol, isopropanol, n-butanol, isobutanol, sec-butanol, tert-butanol or especially methanol ("FAME").

Examples of vegetable oils which can be converted to corresponding alkyl esters and can thus serve as the basis of biodiesel are castor oil, olive oil, peanut oil, palm kernel oil, coconut oil, mustard oil, cottonseed oil, and especially sunflower oil, palm oil, soybean oil and rapeseed oil. Further examples include oils which can be obtained from wheat, jute, sesame and shea tree nut; it is additionally also possible to use arachis oil, jatropha oil and linseed oil. The extraction of these oils and the conversion thereof to the alkyl esters are known from the prior art or can be inferred therefrom.

It is also possible to convert already used vegetable oils, for example used deep fat fryer oil, optionally after appropriate cleaning, to alkyl esters, and thus for them to serve as the basis of biodiesel.

Vegetable fats can in principle likewise be used as a source for biodiesel, but play a minor role.

Examples of animal oils and fats which can be converted to corresponding alkyl esters and can thus serve as the basis of biodiesel are fish oil, bovine tallow, porcine tallow and similar fats and oils obtained as wastes in the slaughter or utilization of farm animals or wild animals.

The parent saturated or unsaturated fatty acids of said vegetable and/or animal oils and/or fats, which usually have 12 to 22 carbon atoms and may bear an additional functional group such as hydroxyl groups, and which occur in the alkyl esters, are especially lauric acid, myristic acid, palmitic acid, stearic acid, oleic acid, linoleic acid, linolenic acid, elaidic acid, erucic acid and/or ricinoleic acid.

Typical lower alkyl esters based on vegetable and/or animal oils and/or fats, which find use as biodiesel or biodiesel components, are, for example, sunflower methyl ester, palm oil methyl ester ("PME"), soybean oil methyl ester ("SME") and especially rapeseed oil methyl ester ("RME").

However, it is also possible to use the monoglycerides, diglycerides and especially triglycerides themselves, for example castor oil, or mixtures of such glycerides, as biodiesel or components for biodiesel.

In the context of the present invention, the fuel oil component (b) shall be understood to mean the abovementioned middle distillate fuels, especially diesel fuels, especially those which boil in the range from 120 to 450° C.

In a further preferred embodiment, the hydrocarbyl-substituted dicarboxylic acid (A) is used together with the aforementioned components (B), (C) and, if desired (D), in fuel oils which have at least one of the following properties:

(α) a sulfur content of less than 50 mg/kg (corresponding to 0.005% by weight), especially less than 10 mg/kg (corresponding to 0.001% by weight);

(β) a maximum content of 8% by weight of polycyclic aromatic hydrocarbons;

(γ) a 95% distillation point (vol/vol) at not more than 360° C.

Polycyclic aromatic hydrocarbons in (β) shall be understood to mean polyaromatic hydrocarbons according to standard EN 12916. They are determined according to this standard.

The fuel oils comprise said hydrocarbyl-substituted dicarboxylic acid (A) in the context of the present invention generally in an amount of from 1 to 1000 ppm by weight, preferably of from 5 to 500 ppm by weight, more preferably of from 3 to 300 ppm by weight, most preferably of from 5 to 200 ppm by weight, for example of from 10 to 100 ppm by weight.

The additive with detergent action (B) or a mixture of a plurality of such additives with detergent action is present in the fuel oils typically in an amount of from 10 to 2000 ppm by weight, preferably of from 20 to 1000 ppm by weight, more preferably of from 50 to 500 ppm by weight, most preferably of from 30 to 250 ppm by weight, for example of from 50 to 150 ppm by weight.

One or more dehazers as additive component (C), if any, are present in the fuel oils generally in an amount of from 0.5 to 100 ppm by weight, preferably of from 1 to 50 ppm by weight, more preferably of from 1.5 to 40 ppm by weight, most preferably of from 2 to 30 ppm by weight, for example of from 3 to 20 ppm by weight.

The cetane number improver (D) or a mixture of a plurality of cetane number improvers is present in the fuel oils normally in an amount of form 10 to 10.000 ppm by weight, preferably of from 20 to 5000 ppm by weight, more preferably of from 50 to 2500 ppm by weight, most preferably of from 100 to 1000 ppm by weight, for example of from 150 to 500 ppm by weight.

Subject matter of the present invention is also a fuel additive concentrate suitable for use in fuel oils, especially in diesel fuel, comprising (A) 0.01 to 40% by weight, preferably 0.05 to 20% by weight, more preferably 0.1 to 10% by weight, of a hydrocarbyl-substituted dicarboxylic acid comprising at least one hydrocarbyl substituent of from 10 to 3000 carbon atoms;

(B) 5 to 40% by weight, preferably 10 to 35% by weight, more preferably 15 to 30% by weight, of at least one additive with detergent action selected from
  (i) compounds with moieties derived from succinic anhydride and having hydroxyl and/or amino and/or amido and/or imido groups;
  (ii) nitrogen compounds quaternized in the presence of an acid or in an acid-free manner, obtainable by addition of a compound comprising at least one oxygen- or nitrogen-containing group reactive with an anhydride and additionally at least one quaternizable amino group onto a polycarboxylic anhydride compound and subsequent quaternization;
  (iii) polytetrahydrobenzoxazines and bistetrahydrobenzoxazines;

(C) 0 to 5% by weight, preferably 0.01 to 5 by weight, more preferably 0.02 to 3.5% by weight, most preferably 0.05 to 2% by weight, of at least one dehazer selected from
  (C1) alkoxylation copolymers of ethylene oxide, propylene oxide, butylene oxide, styrene oxide and/or other oxides, e.g. epoxy based resins
  (C2) alkoxylated phenol formaldehyde resins;

(D) 0 to 75% by weight, preferably 5 to 75% by weight, more preferably 10 to 70% by weight, of at least one cetane number improver;

(E) 0 to 50% by weight, preferably 5 to 50% by weight, more preferably 10 to 40% by weight, of at least one solvent or diluent.

In each case, the sum of components (A), (B), (C), (D) and (E) results in 100%.

Said fuel oils such as diesel fuels, or said mixtures of biofuel oils and middle distillates of fossil, synthetic, vegetable or animal origin, may comprise, in addition to the hydro-carbyl-substituted dicarboxylic acid (A) and components (B) and, if any (C) and/or (D), as coadditives further customary additive components in amounts customary therefor, especially cold flow improvers, corrosion inhibitors, further demulsifiers, antifoams, antioxidants and stabilizers, metal deactivators, antistats, lubricity improvers, dyes (markers) and/or diluents and solvents. Said fuel additive concentrates may also comprise certain of the above coadditives in amounts customary therefor, e.g. corrosion improvers, further demulsifiers, antifoams, antioxidants and stabilizers, metal deactivators, antistats and lubricity improvers.

Cold flow improvers suitable as further coadditives are, for example, copolymers of ethylene with at least one further unsaturated monomer, in particular ethylene-vinyl acetate copolymers. Corrosion inhibitors suitable as further coadditives are, for example, succinic esters, in particular with polyols, fatty acid derivatives, for example oleic esters, oligomerized fatty acids and substituted ethanolamines.

Further demulsifiers suitable as further coadditives are, for example, the alkali metal and alkaline earth metal salts of alkyl-substituted phenol- and naphthalenesulfonates and the alkali metal and alkaline earth metal salts of fatty acids, and also alcohol alkoxylates, e.g. alcohol ethoxylates, phenol alkoxylates, e.g. tert-butylphenol ethoxylates or tert-pentylphenol ethoxylates, fatty acids themselves, alkylphenols, condensation products of ethylene oxide and propylene oxide, e.g. ethylene oxide-propylene oxide block copolymers, polyethyleneimines and polysiloxanes.

Antifoams suitable as further coadditives are, for example, polyether-modified polysiloxanes.

Antioxidants suitable as further coadditives are, for example, substituted phenols, e.g. 2,6-di-tert-butylphenol and 2,6-di-tert-butyl-3-methylphenol, and also phenylenediamines, e.g. N,N'-di-sec-butyl-p-phenylenediamine.

Metal deactivators suitable as further coadditives are, for example, salicylic acid derivatives, e.g. N,N'-disalicylidene-1,2-propanediamine.

A lubricity improver suitable as a further coadditive is, for example, glyceryl mono-oleate.

Suitable solvents and diluents as component (E), especially for diesel performance packages, are, for example, nonpolar organic solvents, especially aromatic and aliphatic hydrocarbons, for example toluene, xylenes, "white spirit" and the technical solvent mixtures of the designations Shellsol® (manufactured by Royal Dutch/Shell Group), Exxol® (manufactured by ExxonMobil) and Solvent Naphtha. Also useful here, especially in a blend with the nonpolar organic solvents mentioned, are polar organic solvents, in particular alcohols such as 2-ethylhexanol, decanol and isotridecanol.

In a further preferred embodiment of the present invention, the gasoline fuels additionally may comprise as additive component (F) at least one carrier oil which is substantially free of nitrogen, selected from synthetic carrier oils and mineral oils. Such fuel-soluble, non-volatile carrier oil is especially to be used as a necessary part of gasoline fuel additive systems and gasoline fuel additive concentrates in combination with poly-isobutenyl monoamines and polyamines (iv) and with polyetheramines (v) for additive component (B). The carrier oil of component (F) may be a synthetic oil or a mineral oil; for the instant invention, a refined petroleum oil is also understood to be a mineral oil.

The carrier oil of component (F) is typically employed in amounts ranging from about 50 to about 2,000 ppm by weight of the gasoline fuel, preferably from 100 to 800 ppm of the gasoline fuel. Preferably, the ratio of carrier oil (F) to additive component (B) will range from 0.35:1 to 10:1, typically from 0.4:1 to 2:1.

Examples for suitable mineral carrier oils are in particular those of viscosity class Solvent Neutral (SN) 500 to 2000, as well as aromatic and paraffinic hydrocarbons and alkoxyalkanols. Another useful mineral carrier oil is a fraction known as "hydrocrack oil" which is obtained from refined mineral oil (boiling point of approximately 360 to 500° C.; obtainable from natural mineral oil which is isomerized, freed of paraffin components and catalytically hydrogenated under high pressure).

Examples for synthetic carrier oils which can be used for the instant invention are olefin polymers with a number average molecular weight of from 400 to 1,800 g/mol, based on poly-alpha-olefins or poly-internal-olefins, especially those based on polybutene or on polyisobutene (hydrogenated or non-hydrogenated). Further examples for suitable synthetic carrier oils are polyesters, polyalkoxylates, polyethers, alkylphenol-initiated polyethers, and carboxylic acids of long-chain alkanols.

Examples for suitable polyethers which can be used for the instant invention are compounds containing polyoxy-$C_2$-$C_4$-alkylene groups, especially polyoxy-$C_3$-$C_4$-alkylene groups, which can be obtained by reacting $C_1$-$C_{30}$-alkanols, $C_2$-$C_{60}$-alkandiols, $C_1$-$C_{30}$-alkylcyclohexanols or $C_1$-$C_{30}$- alkylphenols with 1 to 30 mol ethylene oxide and/or propylene oxide and/or butylene oxides per hydroxyl group, especially with 1 to 30 mol propylene oxide and/or butylene oxides per hydroxyl group. This type of compounds is described, for example, in EP-A 310 875, EP-A 356 725, EPA 700 985 and U.S. Pat. No. 4,877,416.

Typical examples for suitable polyethers are tridecanol propoxylates, tridecanol butoxylates, isotridecanol butoxylates, 2-propylheptanol propoxylates, 2-propylheptanol butoxylates, isononylphenol butoxylates, polyisobutenol butoxylates and polyisobutenol propoxylates. In a preferred embodiment, carrier oil component (F) comprises at least one polyether obtained from $C_1$ to $C_{30}$-alkanols, especially $C_6$- to $C_{18}$-alkanols, or $C_2$- to $C_{60}$-alkandiols, especially $C_8$- to $C_{24}$-alkandiols, and from 1 to 30 mol, especially 5 to 30 mol, in sum, of propylene oxide and/or butylene oxides. Other synthetic carrier oils and/or mineral carrier oils may be present in component (F) in minor amounts.

In the context of the present invention, gasoline fuels means liquid hydrocarbon distillate fuels boiling in the gasoline range. It is in principle suitable for use in all types of gasoline, including "light" and "severe" gasoline species. The gasoline fuels may also contain amounts of other fuels such as, for example, ethanol.

Typically, gasoline fuels, which may be used according to the present invention exhibit, in addition, one or more of the following features:

The aromatics content of the gasoline fuel is preferably not more than 50 volume % and more preferably not more than 35 volume %. Preferred ranges for the aromatics content are from 1 to 45 volume % and particularly from 5 to 35 volume %.

The sulfur content of the gasoline fuel is preferably not more than 100 ppm by weight and more preferably not more than 10 ppm by weight. Preferred ranges for the sulfur content are from 0.5 to 150 ppm by weight and particularly from 1 to 10 ppm by weight.

The gasoline fuel has an olefin content of not more than 21 volume %, preferably not more than 18 volume %, and more preferably not more than 10 volume %. Preferred ranges for the olefin content are from 0.1 to 21 volume % and particularly from 2 to 18 volume %.

The gasoline fuel has a benzene content of not more than 1.0 volume % and preferably not more than 0.9 volume %. Preferred ranges for the benzene content are from 0 to 1.0 volume % and preferably from 0.05 to 0.9 volume %.

The gasoline fuel has an oxygen content of not more than 45 weight %, preferably from 0 to 45 weight %, and most preferably from 0.1 to 3.7 weight % (first type) or most preferably from 3.7 to 45 weight % (second type). The gasoline fuel of the second type mentioned above is a mixture of lower alcohols such as methanol or especially ethanol, which derive preferably from natural source like plants, with mineral oil based gasoline, i.e. usual gasoline produced from crude oil. An example for such gasoline is "E 85", a mixture of 85 volume % of ethanol with 15 volume % of mineral oil based gasoline. Also a fuel containing 100% of a lower alcohol, especially ethanol, is suitable.

The content of alcohols, especially lower alcohols, and ethers in a gasoline fuel of the first type mentioned in the above paragraph is normally relatively low. Typical maximum contents are for methanol 3 volume %, for ethanol 5 volume %, for isopropanol 10 volume %, for tert-butanol 7 volume %, for iso-butanol 10 volume %, and for ethers containing 5 or more carbon atoms in the molecule 15 volume %.

For example, a gasoline fuel which has an aromatics content of not more than 38 volume % and at the same time an olefin content of not more than 21 volume %, a sulfur content of not more than 50 ppm by weight, a benzene content of not more than 1.0 volume % and an oxygen content of from 0.1 to 2.7 weight % may be applied.

The summer vapor pressure of the gasoline fuel is usually not more than 70 kPa and preferably not more than 60 kPa (at 37° C.).

The research octane number ("RON") of the gasoline fuel is usually from 90 to 100. A usual range for the corresponding motor octane number ("MON") is from 80 to 90.

The above characteristics are determined by conventional methods (DIN EN 228).

The gasoline fuels comprise said hydrocarbyl-substituted dicarboxylic acid (A) in the context of the present invention generally in an amount of from 1 to 1000 ppm by weight, preferably of from 5 to 500 ppm by weight, more preferably of from 3 to 300 ppm by weight, most preferably of from 5 to 200 ppm by weight, for example of from 10 to 100 ppm by weight.

The additive with detergent action (B) or a mixture of a plurality of such additives with detergent action is present in the gasoline fuels typically in an amount of from 10 to 2000 ppm by weight, preferably of from 20 to 1000 ppm by weight, more preferably of from 50 to 500 ppm by weight, most preferably of from 30 to 250 ppm by weight, for example of from 50 to 150 ppm by weight.

One or more dehazers as additive component (C), if any, are present in the gasoline fuels generally in an amount of from 0.5 to 100 ppm by weight, preferably of from 1 to 50 ppm by weight, more preferably of from 1.5 to 40 ppm by weight, most preferably of from 2 to 30 ppm by weight, for example of from 3 to 20 ppm by weight.

The one or more carrier oils (F), if any, are present in the gasoline fuels normally in an amount of form 10 to 3.000 ppm by weight, preferably of from 20 to 1000 ppm by weight, more preferably of from 50 to 700 ppm by weight, most preferably of from 70 to 500 ppm by weight, for example of from 150 to 300 ppm by weight.

Subject matter of the present invention is also a fuel additive concentrate suitable for use in gasoline fuels comprising (A) 0.01 to 40% by weight, preferably 0.05 to 20% by weight, more preferably 0.1 to 10% by weight, of a hydrocarbyl-substituted dicarboxylic acid comprising at least one hydrocarbyl substituent of from 10 to 3000 carbon atoms;

(B) 5 to 40% by weight, preferably 10 to 35% by weight, more preferably 15 to 30% by weight, of at least one additive with detergent action selected from
  - (i) compounds with moieties derived from succinic anhydride and having hydroxyl and/or amino and/or amido and/or imido groups;
  - (iv) polyisobutenyl monoamines and polyisobutenyl polyamines;
  - (v) polyoxy-$C_2$- to $C_4$-alkylene compounds terminated by mono- or polyamino groups, at least one nitrogen atom having basic properties;

(C) 0 to 5% by weight, preferably 0.01 to 5 by weight, more preferably 0.02 to 3.5% by weight, most preferably 0.05 to 2% by weight, of at least one dehazer selected from
  - (C1) alkoxylation copolymers of ethylene oxide, propylene oxide, butylene oxide, styrene oxide and/or other oxides, e.g. epoxy based resins
  - (C2) alkoxylated phenol formaldehyde resins;

(E) 0 to 80% by weight, preferably 5 to 50% by weight, more preferably 10 to 40% by weight, of at least one solvent or diluent;

(F) 2 to 50% by weight, preferably 10 to 50% by weight, more preferably 25 to 45% by weight, of at least one carrier oil which is substantially free of nitrogen, selected from synthetic carrier oils and mineral carrier oils.

In each case, the sum of components (A), (B), (C), (D), (E) and (F) results in 100%.

Said gasoline fuels may comprise, in addition to the hydrocarbyl-substituted dicarboxylic acid (A) and components (B) and, if any (C) and/or (F), as coadditives further customary additive components in amounts customary therefor, especially corrosion inhibitors, further demulsifiers, antioxidants and stabilizers, metal deactivators, antistats, friction modifyers, dyes (markers) and/or diluents and solvents such as component (E) as defined above. Said gasoline fuel additive concentrates may also comprise certain of the said coadditives in amounts customary therefor, e.g. corrosion improvers, further demulsifiers, antifoams, antioxidants and stabilizers, metal deactivators, antistats and friction modifyers.

The examples which follow are intended to illustrate the present invention without restricting it.

EXAMPLES

For evaluating the capability of the present hydrocarbyl-substituted dicarboxylic acid (A) of separating water from diesel fuels and gasoline fuels containing each an additive with detergent action, the corresponding standard test method according to ASTM D 1094 was applied. For this test, a glass cylinder was filled with 20 ml of water buffer and 80 ml of the diesel fuel and then shaken for 2 minutes. After the emulsion generated has been allowed to settle for a fixed period of time (5 minutes), the quantities (volumes) of the water loss and the time for 15 ml of water separation were determined.

The test was carried through in a commercially available diesel fuel composed of 100% of middle distillates of fossil origin ("DF1"), in a commercially available biodiesel containing diesel fuel composed of 95% by weight of middle distillates of fossil origin and 5% by weight of FAME ("DF2") and in a commercially available ethanol-free gasoline fuel according to EN 228 ("GF").

Two different hydrocarbyl-substituted dicarboxylic acids (A) were used: A1 was polyisobutenylsuccinic acid and A2 was polyisobutenylsuccinic anhydride. A2 was prepared by thermal en-reaction between polyisobuten (having an $M_n$ of 1000 and a content of 70 mol-% of terminal vinylidene double bonds) and maleic anhydride; A1 was prepared by hydrolysis of A2 with the equimolar amount of water at 100° C. for 16 hours.

A1 or A2, respectively, was admixed to a usual diesel detergent package comprising as component (B)(i) the imide reaction product of polyisobutenylsuccinic anhydride, in which the polyisobutenyl radical has an $M_n$ of 1000, with 3-(dimethylamino)propylamine which is subsequently quaternized with methyl salicylate, as component (C2) a dehazer commercially available from Baker Petrolite under the name of Tolad® 2898 and a commercially available polyether-modified polysiloxane antifoam ("AF"). The concentration of said compounds A1/A2, (B)(i), (C2) and AF in the fuel/water test system are given in the table below.

The following Table 1 shows the results of the determinations:

TABLE 1

| Example | Additives used with concentration [wt.-ppm] (A) | (B)(i) | (C2) | AF | Fuel |
|---|---|---|---|---|---|
| 1a | 0 | 24 | 2.5 | 5 | DF1 |
| 1b | A1: 5 | 24 | 2.5 | 5 | DF1 |
| 1c | A2: 5 | 24 | 2.5 | 5 | DF1 |
| 2a | 0 | 24 | 2.5 | 5 | DF2 |
| 2b | A1: 5 | 24 | 2.5 | 5 | DF2 |
| 2c | A2: 5 | 24 | 2.5 | 5 | DF2 |

Evaluation:

| Example | Water loss after 5 minutes [ml] | 15 ml water separation after [sec] |
|---|---|---|
| 1a | 8 | 336 |
| 1b | 0 | 200 |
| 1c | 1 | 220 |
| 2a | 20 | 655 |
| 2b | 10 | 440 |
| 2c | 5 | 300 |

A1 was admixed to a usual gasoline detergent package comprising as component (B)(i) the imide reaction product of polyisobutenylsuccinic anhydride, in which the polyisobutenyl radical has an $M_n$ of 1000, with 3-(dimethylamino)propylamine which is subsequently quaternized with methyl salicylate, as component (B)(iv) a polyisobutenyl monoamine commercially available under the name of Kerocom® PIBA (according to EP-A 0 244 616) and as component (C2) a dehazer commercially available from Baker Petrolite under the name of Tolad® 2898. The concentration of said compounds A1, (B)(i), (B)(iv) and (C2) in the fuel/water test system are given in the table below.

The following Table 2 shows the results of the determinations:

TABLE 2

| Example | Additives used with concentration [wt.-ppm] (A1) | (B)(i) | (B)(iv) | (C2) | Fuel |
|---|---|---|---|---|---|
| 3a | 0 | 100 | 318 | 10 | GF |
| 3b | 40 | 100 | 318 | 10 | GF |

Evaluation:

| Example | Water loss after 5 minutes [ml] | 15 ml water separation after [min] |
|---|---|---|
| 3a | 20 | >60 |
| 3b | 0 | 1 |

The invention claimed is:

1. A method of improving separation of water from a fuel oil or a gasoline fuel, the method comprising:

contacting (A) a polyisobutenylsuccinic acid having a polyisobutenyl substituent comprising 32 to 100 carbon atoms with a fuel oil or a gasoline fuel comprising (B) at least one nitrogen compound quaternized in the presence of an acid or in an acid-free manner, obtained by addition of a compound comprising at least one oxygen- or nitrogen-containing group reactive with an anhydride and additionally at least one quatemizable amino group onto a polycarboxylic anhydride compound and by subsequent quaternization, as an additive with a detergent action, and (C) as an additive component, an alkoxylation copolymer comprising at least one oxide selected from the group consisting of ethylene oxide, propylene oxide, butylene oxide, and styrene oxide, as a dehazer.

2. The method of claim 1, wherein the alkoxylation copolymer (C) comprises ethylene oxide.

3. The method of claim 1, wherein the alkoxylation copolymer (C) comprises propylene oxide.

4. The method of claim 1, wherein the alkoxylation copolymer (C) comprises butylene oxide.

5. The method of claim 1, wherein the alkoxylation copolymer (C) comprises styrene oxide.

6. The method of claim 1, wherein the alkoxylation copolymer (C) further comprises an epoxy based resin.

7. The method of claim 1, wherein the fuel oil further comprises as an additive component (D) at least one cetane number improver.

8. The method of claim 1, wherein the fuel oil consists of:

(a) 0.1 to 100% by weight of at least one biofuel oil based on one or more fatty acid esters, and (b) 0 to 99.9% by weight of one or more middle distillates of at least one origin selected from the group consisting of fossil origin, synthetic origin, vegetable origin, and animal origin, which are essentially hydrocarbon mixtures and are free of fatty acid esters.

9. The method of claim 1, wherein the fuel oil consist of one or more middle distillates of at least one origin selected from the group consisting of fossil origin, synthetic origin, vegetable, and animal origin, which are essentially hydrocarbon mixtures and are free of fatty acid esters.

10. The method of claim 1, wherein the fuel oil or gasoline fuel has at least one of the following properties:

(α) a sulfur content of less than 50 mg/kg;

(β) a maximum content of 8% by weight of polycyclic aromatic hydrocarbons; and (γ) a 95% distillation point (vol/vol) at not more than 360° C.

11. A fuel additive concentrate for a fuel oil, comprising:

(A) 0.01 to 40% by weight of a polyisobutenylsuccinic acid having a polyisobutenyl substituent comprising 20 to 200 carbon atoms;

(B) 5 to 40% by weight of at least one additive with detergent action, wherein the at least one additive is selected from the group consisting of (i) a compound comprising a moiety derived from succinic anhydride and having a hydroxyl group, amino group, amido, imido group, or a combination thereof;

(ii) a nitrogen compound quaternized in the presence of an acid or in an acid-free manner, obtained by addition of a compound comprising at least one oxygen- or nitrogen-containing group reactive with an anhydride and additionally at least one quaternizable amino group onto a polycarboxylic anhydride compound and by subsequent quaternization; and (iii) a polytetrahydrobenzoxazine or a bistetrahydrobenzoxazine;

(C) 0.01 to 5% by weight of an alkoxylation copolymer comprising at least one oxide selected from the group consisting of ethylene oxide, propylene oxide, butylene oxide, and styrene oxide, as a dehazer;

(D) 0 to 75% by weight of at least one cetane number improver; and (E) 0 to 50% by weight of at least one solvent or diluent.

12. The method of claim 1, wherein the alkoxylation copolymer further comprises at least one epoxy based resin.

* * * * *